US005402118A

United States Patent [19]

Aoki

[11] Patent Number: 5,402,118

[45] Date of Patent: Mar. 28, 1995

[54] METHOD AND APPARATUS FOR MEASURING TRAFFIC FLOW

[75] Inventor: Masanori Aoki, Osaka, Japan

[73] Assignee: Sumitomo Electric Inductries, Ltd., Osaka, Japan

[21] Appl. No.: 52,736

[22] Filed: Apr. 27, 1993

[30] Foreign Application Priority Data

Apr. 28, 1992 [JP] Japan ..... 4-110311

[51] Int. Cl.[6] ..... G08G 1/017

[52] U.S. Cl. ..... 340/937; 340/933; 364/436; 367/97; 377/9; 382/48; 382/43; 382/1; 382/22; 382/54

[58] Field of Search ..... 340/937, 933, 943, 941, 340/942; 364/436; 367/97; 377/6.9, 26; 382/48, 31, 1, 22, 43, 42, 54

[56] References Cited

U.S. PATENT DOCUMENTS

| | | | |
|---|---|---|---|
| 4,214,265 | 7/1980 | Olesen | 340/937 |
| 4,245,633 | 5/1988 | Waksman et al. | 382/42 |
| 4,433,325 | 2/1984 | Tanaka et al. | 340/933 |
| 4,449,144 | 5/1984 | Suzuki | 382/31 |
| 4,847,772 | 7/1989 | Michalopoulos et al. | 340/937 |
| 4,881,270 | 11/1989 | Knecht et al. | 382/43 |
| 4,985,618 | 1/1991 | Inada et al. | 382/54 |
| 5,034,986 | 7/1991 | Karmann et al. | 382/1 |
| 5,091,967 | 2/1992 | Ohsawa | 382/22 |
| 5,212,740 | 5/1993 | Paek et al. | 382/22 |
| 5,243,663 | 9/1993 | Kudoh | 382/48 |

OTHER PUBLICATIONS

Sumitomo Electric Technical Review, vol. 25, Sep. 1985, pp. 58–62.

N. Hashimoto, et al., "Development of an Image-Processing Traffic Flow Measuring System", Sumitomo Electric Technical Review, No. 25, Jan., 1986, pp. 133–138.

*Primary Examiner*—John K. Peng
*Assistant Examiner*—Nina Tong
*Attorney, Agent, or Firm*—Foley & Lardner

[57] ABSTRACT

This invention aims at providing an traffic flow measurement method and apparatus attaining the stable measurement without being affected by the change in the brightness of the external environment such as daytime vehicle front, et al. In order to achive the above object, the traffic flow measurement apparatus for practicing the traffic flow measurement method comprises image input unit for receiving image information derived from the ITV camera, detection unit for detecting sampling points which are candidates for a vehicle fronts in a measurement area, and measurement processing unit for determining a position of the vehicle front in the measurement area from the candidate points detected by the detection unit. The measurement processing unit calculates a vehicle velocity based on a change between a position of the vehicle front derived from past image information and a current position of the vehicle front.

18 Claims, 7 Drawing Sheets

$$\begin{array}{c} \\ i-1 \rightarrow \\ i \rightarrow \end{array} \begin{array}{c} \begin{array}{ccc} j-1 & j & j+1 \end{array} \\ \begin{bmatrix} 1 & 2 & 1 \\ -1 & -2 & -1 \end{bmatrix} \end{array}$$

$$\begin{array}{c} \\ i-1 \rightarrow \\ i \rightarrow \\ i+1 \rightarrow \end{array} \begin{array}{c} \begin{array}{ccc} j-1 & j & j+1 \end{array} \\ \begin{bmatrix} 1 & 2 & 1 \\ 0 & 0 & 0 \\ -1 & -2 & -1 \end{bmatrix} \end{array}$$

METHOD AND APPARATUS FOR MEASURING TRAFFIC FLOW

BACKGROUND OF THE INVENTION

1. Field of the Invention The present invention relates to method and apparatus for measuring traffic flow by detecting the presence of a vehicle, the type of vehicle and the individual vehicle velocity from an image information picked up by an ITV (industrial television ) camera.

The type of vehicle in the present specification means a classification of car size such as a small size car and a big size car, unless otherwise specified.

2. Related Background Art

In a traffic control system for a public road and a highway, a number of vehicle sensors are arranged to measure traffic flow. One advanced system for such measurement is a traffic flow measurement system by an ITV camera.

The above traffic flow measurement system uses the ITV camera as a sensor. Specifically, it real-time analyzes image information derived by the ITV camera which obliquely looks down a road to determine the presence of a vehicle and a velocity thereof.

FIG. 1 illustrates an outline of a prior art traffic flow measurement system. FIG. 1A shows a measurement area 51 displayed on an image screen of the ITV camera. FIG. 1B shows measurement sampling points set for each lane in the measurement area 51. FIG. 1C shows a bit pattern of measurement sampling points transformed from the measurement sampling points in the measurement area 51 to orthogonal coordinates and a vehicle region (represented by code level "1"). FIG. 1D shows a bit pattern of a logical OR of the elements along a crossing direction of the road (The vehicle region is represented by the code level "1").

The detection of the vehicle region, that is, a process for imparting a code level "0" or "1" to each measurement sampling point is effected by calculating a difference between brightness data of each measurement sampling point and road reference brightness data and binarizing the difference.

Traffic amount, velocity, type of vehicle and the number of vehicles present can be determined based on a change in the detected vehicle region (represented by the code level "1"). (See SUMITOMO ELECTRIC, No. 127, pages 58–62, September 1985.) The algorithm of the traffic flow measuring method in the prior art traffic flow measurement system described above has the following problems. First, since the road brightness is to be changed depending on time of day such as morning or evening and as a result of weather, a manner of setting the road reference brightness data is complex.

Specifically, in the evening, a detection precision is low because a difference between the brightnesses of a car body and the road is small. At night, since head lights are subject to be recognized, a detection rate for a car which lights only low brightness small lamps (lights to indicate a car width) decreases.

Secondly, since the bit pattern of the measurement area (FIG. 1C) viewed along the crossing direction of the road (logical OR of the elements along the crossing direction) is determined and the vehicle region is determined based on the bit pattern as shown in FIG. 1D, the measurement area must be divided for each lane. A new problem arising from this method is that a vehicle which runs across the lane is counted as two vehicles.

Thirdly, a non-running car or parked car is recognized as the road when it is compared with the road reference brightness data, and the presence of such car is not detected.

SUMMARY OF THE INVENTION

It is an object of the present invention to provide traffic flow measurement method and apparatus having the following advantages.

Firstly, the vehicle region is stably detected without being affected by a change in the brightness of an external environment.

Secondly, the vehicles can be exactly measured even if there are a plurality of lanes.

Thirdly, traffic flow can be measured for each type of vehicle.

Fourthly, a running car and a non-running car or a parked car in a measurement area can be recognized.

In order to achieve the above object, the traffic measurement method of the present invention comprises the steps of:

- picking up an image of a road by an ITV camera mounted on a side of the road;
- determining brightnesses of a plurality of sampling points in a measurement area based on the image information derived from the camera;
- effecting spatial differentiation on the brightness information of the sampling points to enhance edges of vehicles running in the area;
- binarizing the differentiation signals by comparing them with a predetermined threshold;
- applying a mask having a substantially equal width to a vehicle width to the resulting binary image;
- searching candidate points for a vehicle front from the distribution of signals of the edges in the mask when the number of signals of the edges in the mask is larger than a reference;
- determining a position of the vehicle front based on a positional relationship of the candidate points for the vehicle front; and
- calculating a vehicle velocity based on a change between a position of the vehicle front derived from past image information and a current position of the vehicle front.

A traffic flow measurement apparatus for practicing the above traffic flow measurement method comprises image input unit for receiving image information derived from the ITV camera, a detection unit for detecting sampling points which are candidates for a vehicle front in a measurement area, and a measurement processing unit for determining a position of the vehicle front in the measurement area from the candidate points detected by the detection unit. The measurement processing unit calculates a vehicle velocity based on a change between a position of the vehicle front derived from past image information and a current position of the vehicle front.

In accordance with the above method and apparatus, the measurement area is represented by using a sampling point system. In this system, the measurement area is coordinate-transformed so that it is equi-distant by a distance on the road. As a result, there is no dependency on a viewing angle of the ITV camera and the data can be treated as if it were measured from directly top of the road.

The area (measurement area) determined by the sampling point system is represented by an M×N array, where M is the number of samples along the crossing direction of the road, and N is the number of samples along the running direction of the vehicle. The coordinates of the sampling point are represented by (i, j) and a brightness of the point is represented by P(i, j). The detection unit effects spatial differentiation for the brightness P(i, j) of each sampling point. The differentiation may be effected in any of various methods. Whatever method may be adopted, an image resulting from the spatial differentiation has edge areas of the vehicle enhanced so that it is hard to be affected by the color of the vehicle body and the external brightness. Namely, a contrast is enhanced in daytime, night and evening, and when the image resulting from the spatial differentiation is to be binarized, it is not necessary to change the road reference brightness data in accordance with the brightness of the external environment, which is required in the prior art.

When the image resulting from the spatial differentiation is binarized, the edge area of the vehicle and a noise area produce different signals (code level "1") than background (code level "0"). A mask corresponding to a width of the vehicle is then applied to the binary image. When the number of elements in the mask which have the code level "1" exceeds a threshold, a candidate point of the front of the vehicle is determined by determining a center of gravity of the sampling points in the mask which have code level "1". The process of determining the candidate point of the front of the vehicle is simple to handle because it is not necessary to take the difference in the daytime vehicle front, the night head light and the small lamp.

Further, since the mask is applied across the lanes of the road, the vehicle which changes the lane during the measurement is counted as one vehicle. By preparing a plurality of masks of different sizes which vary with the type of vehicle, a big size car be determined by a big mask and a small size car can be determined by a small mask.

Since a plurality of candidate points of the front of the vehicle may be detected, the front of the vehicle is finally determined from a positional relation of the candidate points, and the velocity of the vehicle is calculated from a change in the finally determined front point. Thus, the vehicle velocity can be calculated for each type of vehicle detected by the corresponding mask.

On the other hand, the present invention provides a method for determining the front point when a plurality of candidate points of the front of the vehicle are detected in a predetermined size of area, for example, an area corresponding to the vehicle size (vehicle region).

Namely, an area having a larger number of signals of the edge of the vehicle (code level "1" signals) in the mask, or an area closer to the running direction of the vehicle is selected as an effective point of the vehicle front. Where there are a plurality of effective points of the vehicle front, a point of the effective points of the vehicle front in the vehicle region corresponding to the mask, which is in the running direction of the vehicle is selected as the vehicle front point.

The above process is effected by a measurement processing unit in the traffic flow measurement apparatus of the present invention. Even if a portion other than the vehicle front such as an edge of a front glass or a sun roof of the vehicle having a varying brightness is detected, a most probable vehicle front position (effective point) is extracted. Where there are a plurality of effective points, only one vehicle front point (finally determined point) can be determined for the vehicle region because it is not possible that there are two vehicle front points in the vehicle region.

The measurement processing unit calculates the vehicle velocity in the following manner.

A prediction velocity range of the vehicle from zero or a negative value to a normal running velocity of the vehicle is predetermined. If the vehicle front point is detected in image information of a predetermined time before, it is assumed that an area from the vehicle front point to a point displaced by (vehicle prediction speed range)×(predetermined time)

is a next area to which the vehicle runs into, and if there is a current vehicle front point in this area (determination area), the vehicle velocity is calculated from a difference between those two vehicle front points.

When the vehicle velocity is calculated in this manner, even the non-running car or the parked car can be detected because zero or a negative value is included in the range of the vehicle prediction speed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DETAILED DESCRIPTION OF THE PREFERRED EMBODIMENTS

One embodiment of the present invention is now explained with reference to FIGS. 2-8, 9A, and 9B.

Figure 1A:
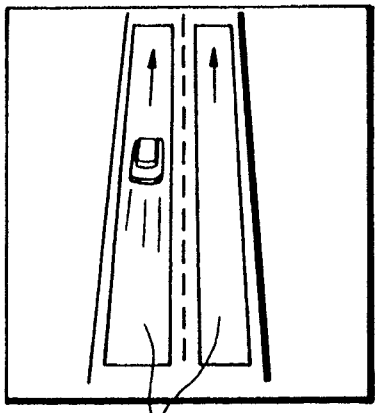
Fig. 1A PRIOR ART
FIGS. 1A–1D illustrate an outline of a prior art traffic flow measurement method.
Figure 1B:
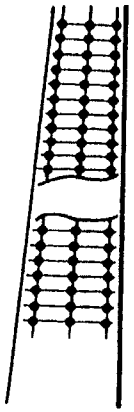
Fig. 1B PRIOR ART
Figure 1C:
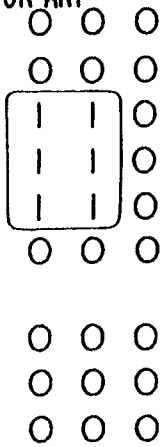
Fig. 1C PRIOR ART
Figure 1D:
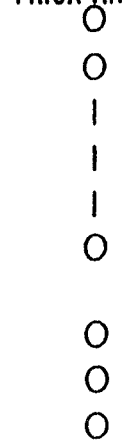
Fig. 1D PRIOR ART
Figure 2:
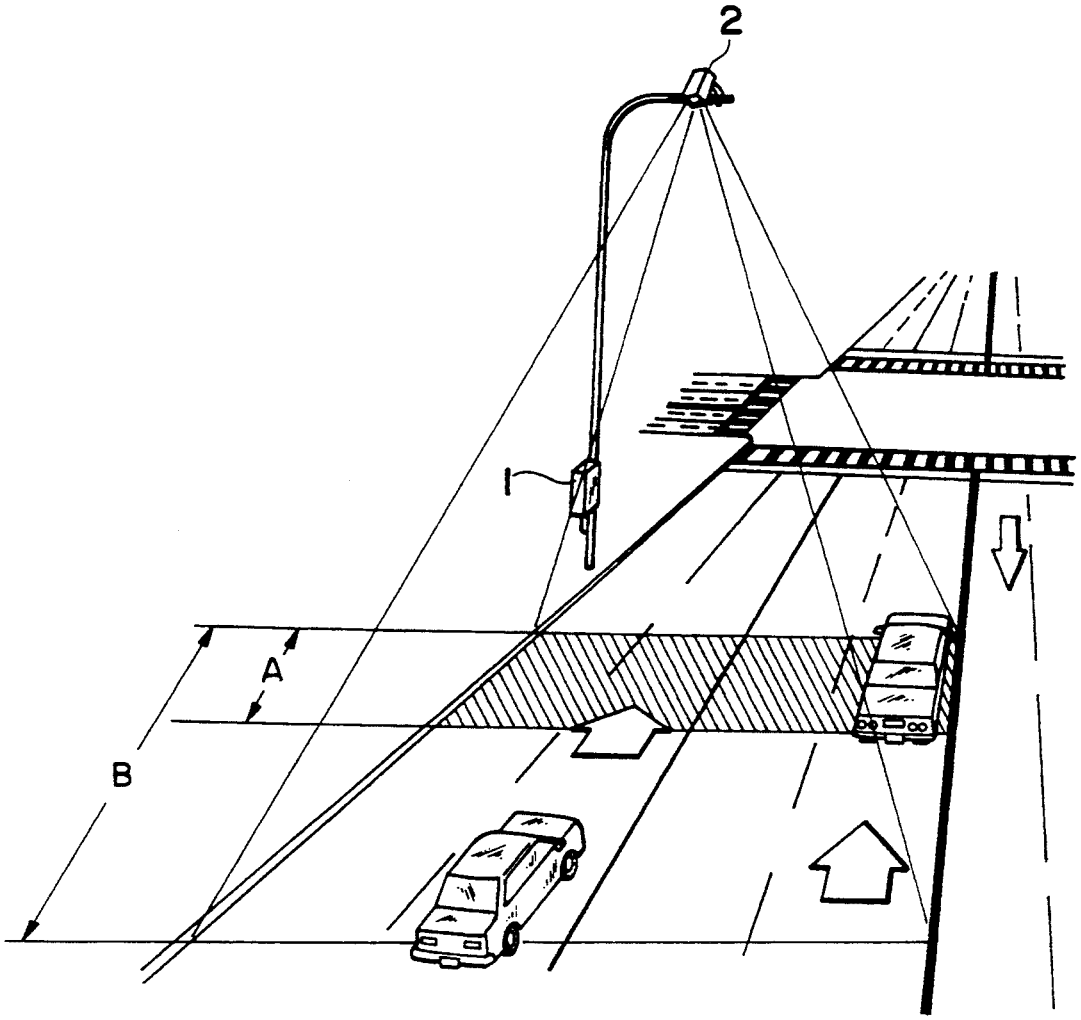
FIG. 2 shows the installation of an ITV camera 2.

FIG. 2 shows a conceptual installation chart of an ITV camera 2. The ITV camera 2 is mounted on top of a pole mounted on a side of a road, and a control unit 1 of the traffic flow measurement apparatus of the present invention is arranged at a bottom of the pole. A view field of the ITV camera 2 covers an area B (measurement area) which covers all lanes of 4 lanes per one way.

Figure 3:
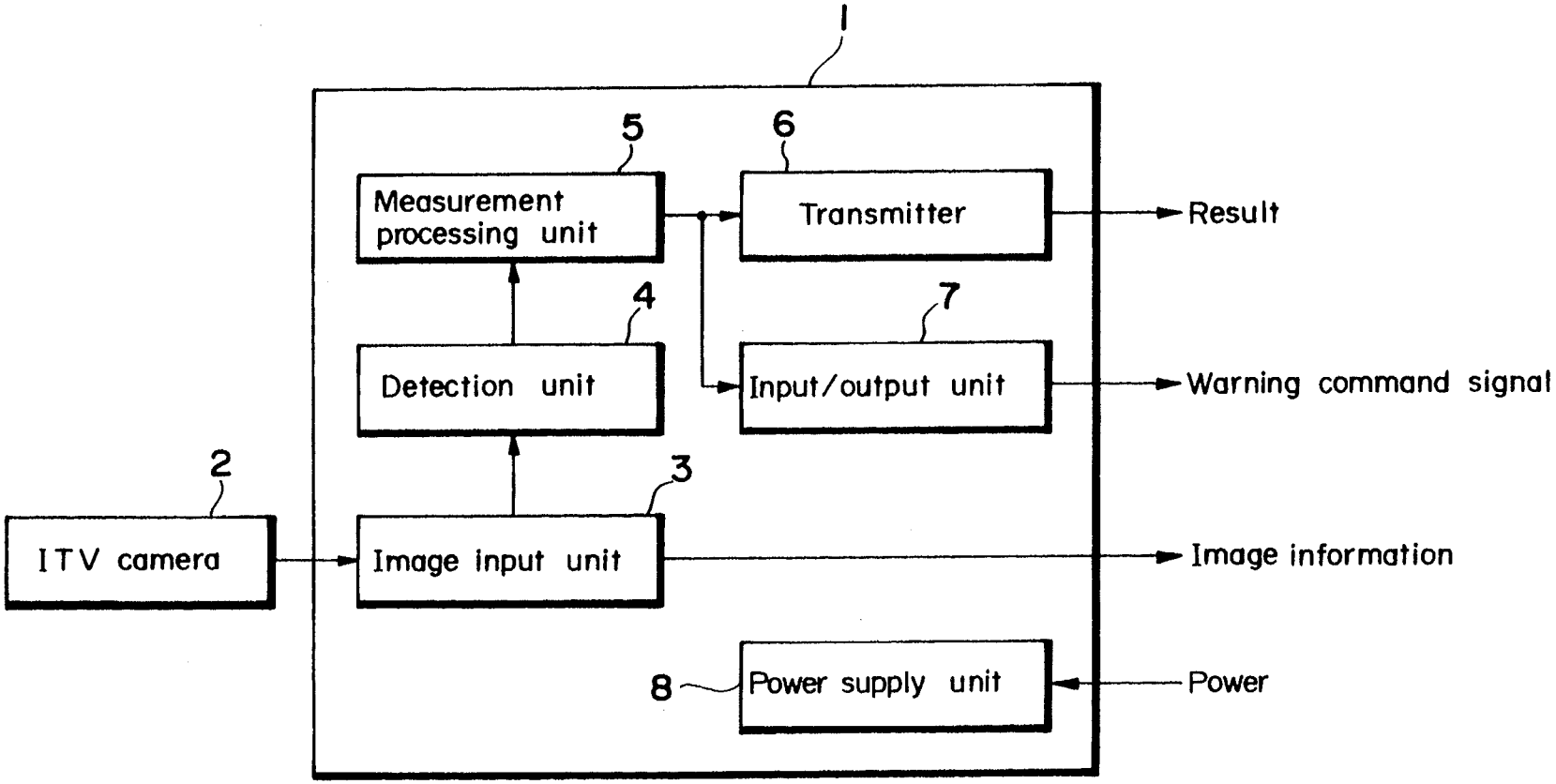
FIG. 3 shows a block diagram of a configuration of a control unit 1 in a traffic flow measurement apparatus of the present invention.

FIG. 3 shows a configuration of equipment in the control unit 1. Control unit 1 includes an image input unit 3 for receiving an image signal produced by the ITV camera 2, a detection unit 4 for detecting a candidate point of a vehicle front and a measurement processing unit 5 for determining a vehicle front point and calculating a vehicle velocity, a transmitter 6 for transmitting a traffic flow measurement result calculated by the measurement processing unit 5 to a traffic control center through a communication line, an input/output unit 7 for issuing a warning command signal, and a power supply unit 8 for supplying a power to the control unit 1.

A processing algorithm of the traffic flow measurement of the control unit 1 is explained with reference to FIGS. 4 and 5.

The image input unit 3 receives brightness values p(i, j) of the image signal produced by the ITV camera 2 and stores the brightness values P(i, j) as an M×N matrix coordinate data having M measurement sampling points along the crossing direction of the road ($\xi$ direction) and N measurement sampling points along the running direction of the vehicle ($\eta$ direction) (step ST1).

Figure 4:
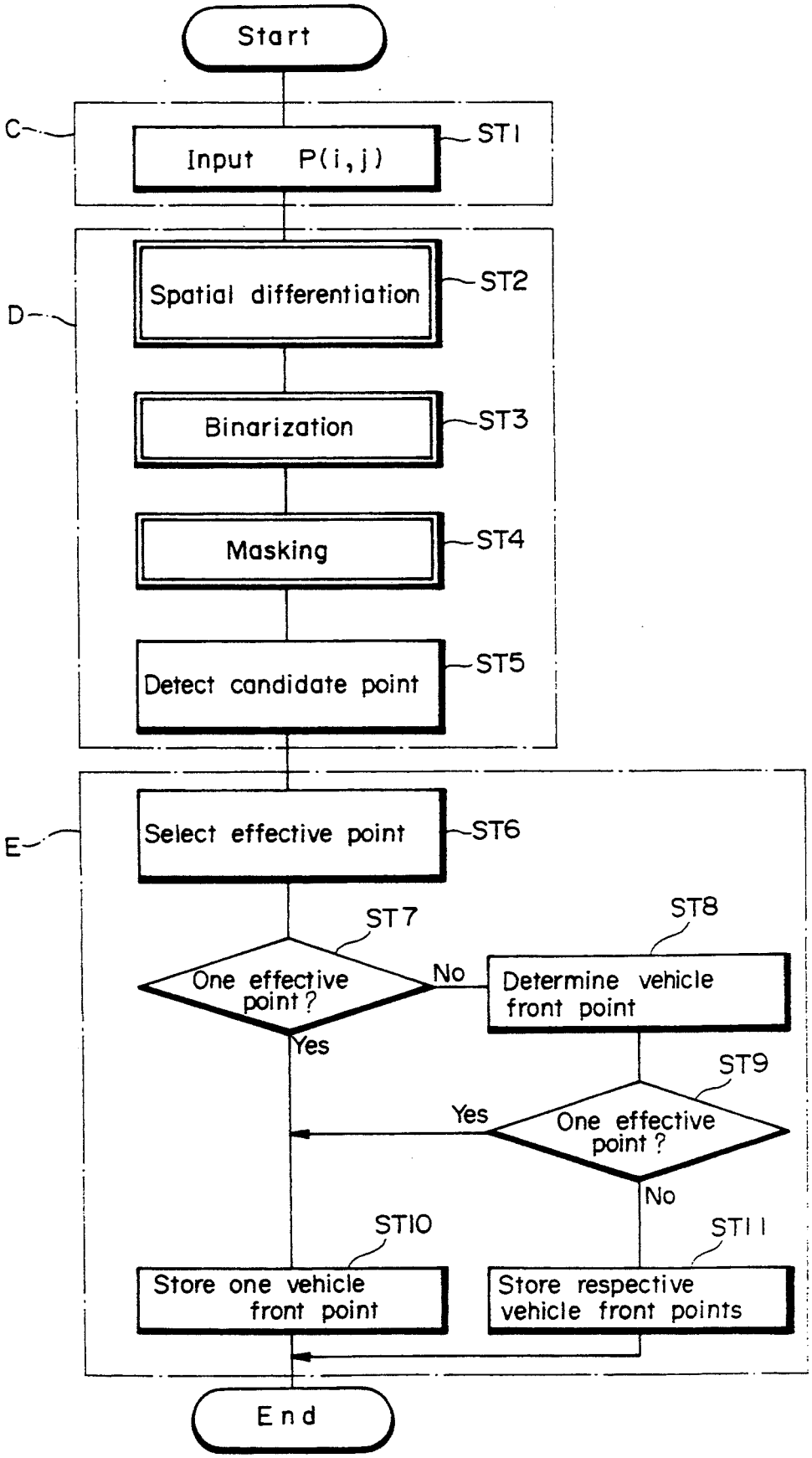
FIG. 4 shows a first flow chart illustrating an operation of a traffic flow measurement method of the present invention.
Figure 5:
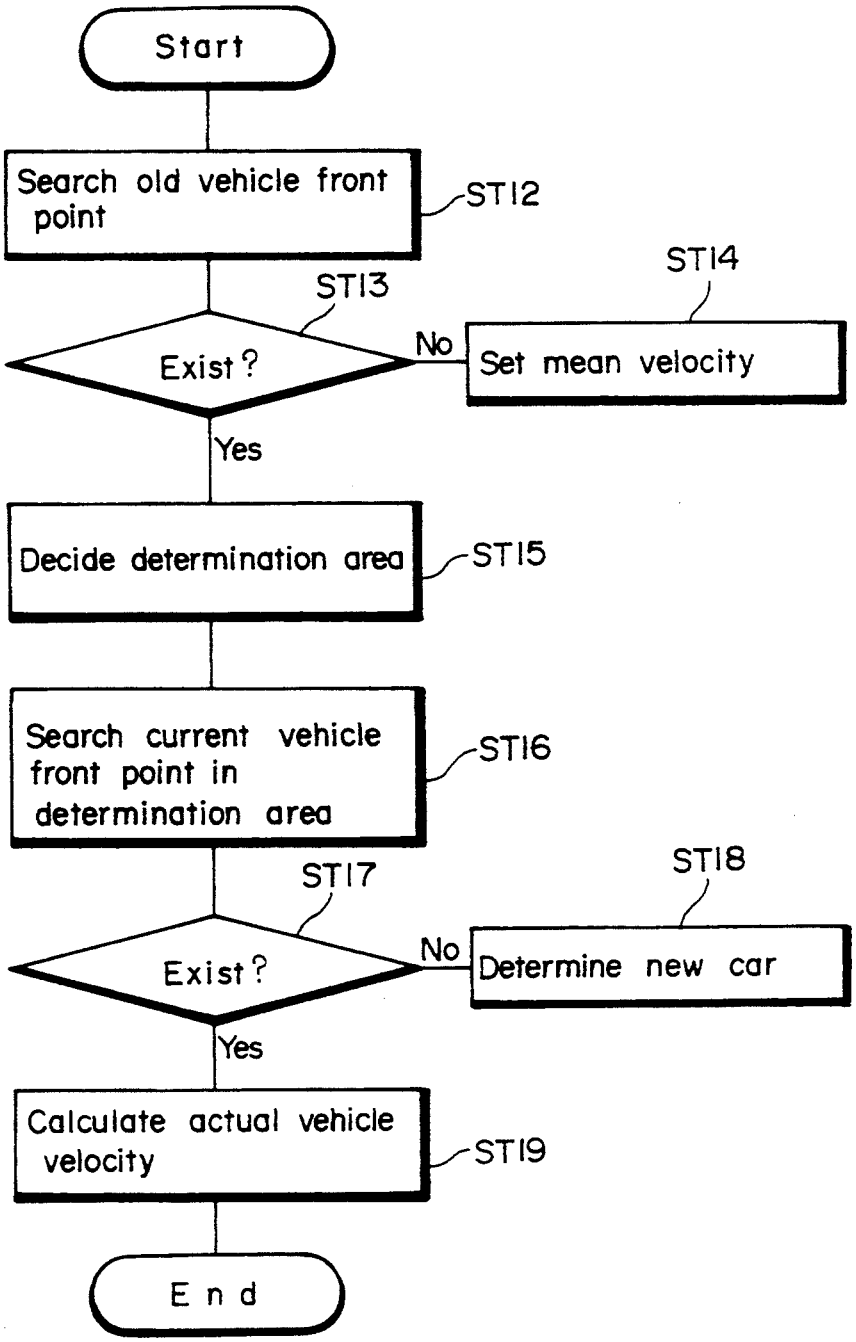
FIG. 5 shows a second flow chart illustrating the operation of the traffic flow measurement method of the present invention.

Pitches of the measurement sampling points are $\Delta\xi$ and $\Delta\eta$, respectively, and the operation of the image input unit 3 is shown by C in the flow chart of FIG. 4.

The detection unit 4 performs the steps indicated by letter D in the flow chart of FIG. 4.

Figures 6, 7A, 7B:
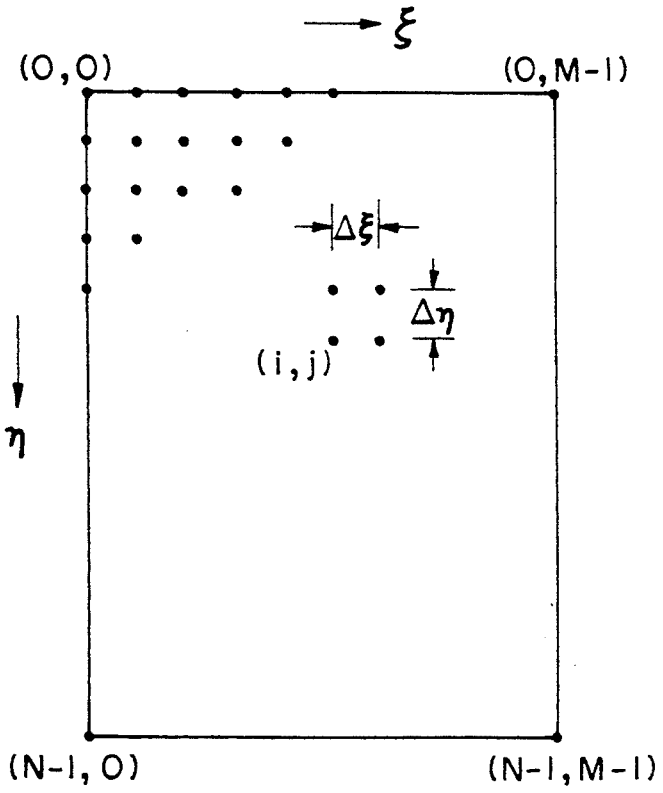
FIG. 6 shows a measurement area (arrangement of measurement sampling points) derived by orthogonal-transforming the measurement sampling points in an image picked up by the ITV camera 2.
FIGS. 7A and 7B show examples of a Sobel operator used in the spatial differentiation.

Namely, Sobel operators shown in FIGS. 7A and 7B are operated to the pixels (i, j) of the matrix shown in FIG. 6 to effect the spatial differentiation to all components to determine differentiation P'(i, j) of the brightness P(i, j) (step ST2).

$$P'(i,j)=P(i-1,j-1)+2P(i-1,j)+P(i-1,j+1)-P(i,j-1)-2P(i,j)-P(i,j+1)$$

In a special case where an area for which the spatial differentiation is to be effected (for example, a 2×3 matrix area in FIG. 7A) overflows from the measurement area B, the following process is to be taken.

$$P'(0,j)=0$$

$$P'(i,0)=2P(i-1,0)+P(i-1,1)-2P(i,0)-P(i,1)$$

$$P'(i,M-1)=P(i-1,M-2)+2P(i-1,M-1)-P(i,M-2)-2P(i,M-1)$$

The detection unit 4 applies a threshold Th1 which has been given as a constant to binarize all pixels which have been processed by the spatial differentiation (step ST3). Namely, If P'(i, j)≧=Th1 then P'(i, j)=1, If P'(i, j)<Th1 then P'(i, j)=0

Figure 8:
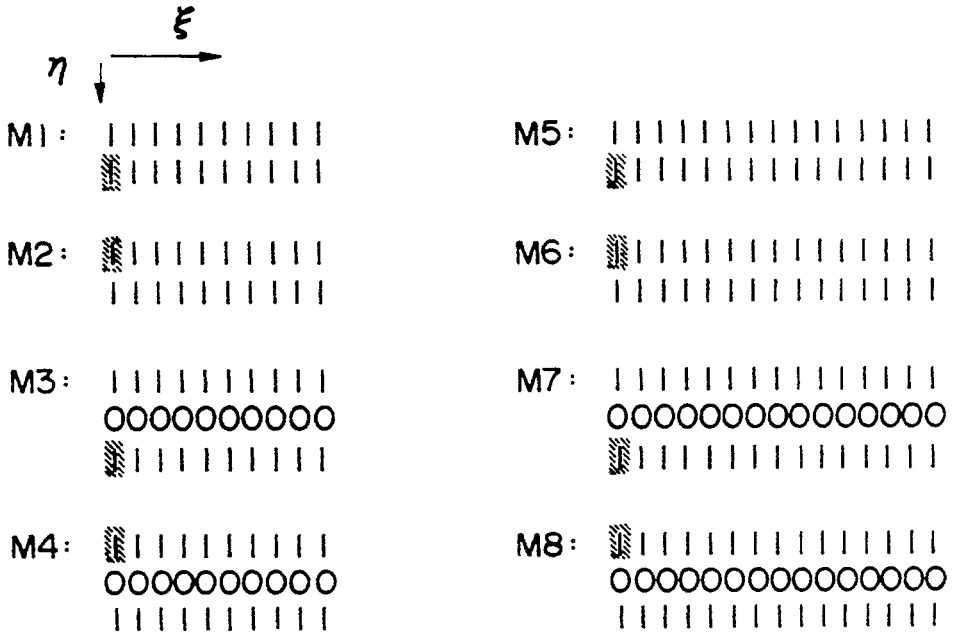
FIG. 8 shows eight different mask patterns prepared for different types of vehicle.

Then, the detection unit 4 applies the masking to specify the type of vehicle (step ST4). In this step, masks are prepared for the types of vehicle such as small size car and big size car. The masks prepared are of eight types from M1 to M8 as shown in FIG. 8. M1 to M4 represent the small size car and M5 to M8 represent the big size car. M1, M2, M5 and M6 represent two-line mask, and M3, M4, M7 and M8 represent three-line mask. The pixel under consideration (hatched pixel (i, j) ) is at the left bottom in M1, M3, M5 and M7, and at the left top in M2, M4, M6 and M8.

To apply the mask, the M×N matrix shown in FIG. 6 (corresponding to the measurement area B) is raster-scanned, and when the pixel having the code level "1" first appears, the pixel is aligned to the "pixel under consideration" of the mask. In the raster scan, if the pixels having the code level "1" appear continuously, no masking is applied to the second and subsequent pixels. The pixels in the mask having the code level "1" are counted. The count is referred to as a mask score.

Figure 9A:
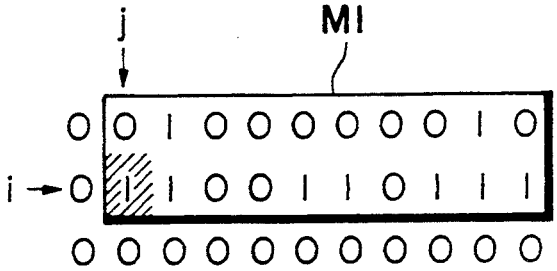
FIGS. 9A and 9B show a mask M1 and a mask M2 applied to pixels (i, j) on the measurement area shown in FIG. 6.
Figure 9B:
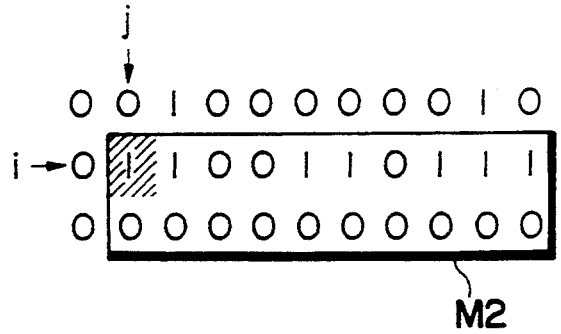

For example, in FIG. 9A, the mask M1 is applied to a pixel (i, j) under consideration, that is, second from the left end and second from the bottom. The score in this example is 9. In FIG. 9B, the mask M2 is applied to a pixel (i, j) under consideration, that is, second from the left end and second from the bottom. The score in this example is 7.

The score thus determined is stored in pair with the mask number with respect to the pixel under consideration. For example, in FIG. 9A, it is stored in a form of (i, j, M1, 9). In FIG. 9B, it is stored in a form of (i, j, M2, 7).

Eight masks are applied to the pixel under consideration, and the mask with the highest score is selected. If the mask score for a big size car and the mask score for a small size car is equal, the mask for the small size car is selected.

If the score of the selected mask is higher than a predetermined threshold, that mask is applied once more and a center of gravity is determined based on the distribution of the pixels having code level "1". This center of gravity is referred to as a candidate point for the vehicle front (step ST5).

For the candidate point for the vehicle front detected by the detection unit 4, the coordinates, the mask number and the maximum score thereof are stored in set. For example, in FIG. 9A, assuming that the coordinates of the center of gravity are (i, j+5), then (i, j+5, M1, 9) is stored.

The measurement processing unit 5 then caries out portion E of the flow chart shown in FIG. 4 based only on the information of the candidate point for the vehicle front detected by the detection unit 4 without using the binary data.

The information of the candidate point for the vehicle front may include a plurality of pixel positions indicating the vehicle front or information of pixel positions other than the vehicle front such as a boundary of a front glass and a roof or a sun roof. Of those candidate points, a most probable vehicle front position (effective point of the vehicle front) must be extracted.

Thus, the measurement processing unit 5 examines the information of the candidate points in sequence. If there are n candidate points in a neighborhood area (for example, an area substantially corresponding to one vehicle area), the first (n=1) candidate point is first registered as an effective point of the vehicle front. Then, the scores of the candidate points having n=2 et seq are compared with the score of the registered effective point, and the candidate point having a larger score is newly registered as the effective point of the vehicle front. A candidate point closer to the running direction of the vehicle is registered as the effective point of the vehicle front. The candidate point which is not selected as the effective point by the comparison are deleted from the registration. In this manner, the effective point of the vehicle front is selected from the candidate points in the neighborhood area. The neighborhood area is sequentially set starting from the bottom candidate point of the matrix shown in FIG. 6.

If one effective point is selected by the above process (step ST7), it is determined as the vehicle front point and stored (step ST10). If there are a plurality of effective points in the area (step ST7), the vehicle front point is determined from those effective points (step ST8) in the following manner.

Information of the pixels of the effective points are examined in sequence. If there are m effective points, the first effective point is temporarily registered as the vehicle front point. Then, the next effective point is compared with the registered effective point. If both points are within an area determined by the length and the width of the vehicle (one vehicle area) of a big size car or a small size car corresponding to the mask, as determined by the positional relationship of those points, one of the registered vehicle front point and the effective point of the vehicle front under comparison which is downstream along the running direction of the vehicle is selected as the vehicle front point, and the other point is eliminated from the candidate. In this manner, the information of the respective effective points are compared with the reference (registered) vehicle front point, and the finally selected effective point is selected as the vehicle front point.

If only one effective point is determined as the vehicle front point as the result of examination of the number of vehicle front points (step ST9), it is stored (step ST10). If there are more than one vehicle front point, it is determined that more than one vehicle are present in the measurement area B and the respective vehicle front points are stored (step ST11).

An algorithm of the vehicle velocity calculation carried out by the measurement processing unit 5 is explained with reference to a flow chart of FIG. 5.

Of the image information processed and from which the vehicle front point was determined, the information of the vehicle front point of one frame behind is read to search an old vehicle front point (step ST12). If there is no old vehicle front point in that frame (step ST13), the current vehicle front point is stored and it is outputted, and a mean velocity (a normal vehicle running velocity) calculated for each lane is set as a vehicle velocity (step ST14). On the other hand, if there is an old vehicle front point in that frame (step ST13), an area from the old vehicle front point to a point spaced by a distance (vehicle prediction velocity range)×(one frame period)

is selected as an area which the vehicle next runs into, that is, an area for determining the presence of the vehicle (determination area A in FIG. 2) (step ST15). The current vehicle front point is searched within this area (steps ST16 and ST17). The "vehicle prediction velocity range" extends from a negative value to a positive value. The negative value is included in order to detect the non-running car or the parked car.

If there is a new vehicle front point in the determination area A (step ST17), the instantaneous vehicle velocity is calculated based on a difference of distance between the new vehicle front point and the old vehicle front point of one frame behind (step ST19). If the calculated velocity is negative, the velocity is set to zero. If there is no new vehicle front point in the determination area A (step ST17), it is determined that the vehicle has newly run into the measurement area B (step ST18) and the information of the vehicle front point is stored and it is outputted.

In this manner, the current vehicle front point in the measurement area B, the type of vehicle and the velocity are measured.

The determination area A varies with the position of the vehicle front point in the measurement area B.

In accordance with the present invention, since the spatial differentiation is effected at each measurement sampling point in the measurement area B, the resulting image has its edge portions of the vehicle enhanced and is not affected by the color of the vehicle body and the brightness of the external environment. Namely, the contrast is enhanced in daytime, night and evening, and when the data is binarized, it is not necessary to change the road reference brightness data in accordance with the brightness of the external environment, which has been required in the prior art. Accordingly, the stable measurement is attained without being affected by the change in the brightness of the external environment such as daytime vehicle front, night headlight and small lamp.

Further, in accordance with the present invention, since the masking is applied to permit the crossing of the lane, even the vehicle which changes a lane to other lane is counted as one vehicle. Accordingly, the vehicle can be exactly measured without dependency on the lane.

Since masks representing various vehicle widths are prepared and the masking is applied by using all those masks,the traffic flow for each type of vehicle can be measured.

The number of candidate points for the vehicle front detected in one vehicle area is reduced to determine a minimum number of vehicle front points for a particular vehicle size, and the vehicle velocity is calculated based on the change in the vehicle front points. Accordingly, the process is simplified and the traffic flow can be exactly measured.

The area in which the new vehicle front point may exist, in the current frame is determined as the determination area (area A in FIG. 2) by referring the position information of the old vehicle front point in the previous frame, the new vehicle front point in the determination area is extracted and the vehicle velocity is determined. Since zero or negative value is included in the vehicle prediction velocity range, the non-running car or the parked car can be detected.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A traffic measurement method comprising the steps of:

obtaining image information of a plurality of sampling points in a measurement area set on a road using an ITV camera mounted to view the road;

effecting spatial differentiation based on brightness information contained in the image information of the sampling points to detect an edge portion of a running vehicle as well as a stopped vehicle;

binarizing the brightness information of the sampling points by comparing differentiation signals derived from the spatial differentiation with a predetermined threshold;

masking pixels detected as the edge portion of the binary image derived from the binarization with mask patterns respectively having a width corresponding to vehicle types;

selecting one of the mask patterns having a width in correspondence with a type of the running vehicle;

selecting one or more candidate points for a vehicle front as one or more pixels at a center of gravity of the pixels of the edge portion present in the selected mask pattern;

determining a vehicle front point at a first predetermined time from the candidate points selected within the measurement area; and calculating a vehicle velocity based on a distance that the vehicle front point has moved in a predetermined time period from said first predetermined time.

2. The traffic flow measurement method according to claim 1 wherein said mask patterns are masked across a lane of the road.

3. The traffic flow measurement method according to claim 1 wherein each of said mask patterns respectively correspond to one of different vehicle widths.

4. The traffic flow measurement method according to claim 1 wherein the step of selecting one of the mask patterns further comprises the step of selecting one of said mask patterns having more pixels of the edge portion than a predetermined reference.

5. The traffic flow measurement method according to claim 1 further comprising the step of selecting one or more of a plurality of candidate points for the vehicle front present in the measurement area having more pixels of the edge portion in the mask pattern as an effective point of the vehicle front.

6. The traffic flow measurement method according to claim 5 wherein one of a plurality of effective points of the vehicle front present in the measurement area which is located downstream along a running direction of the vehicle is finally selected as the vehicle front point to determine the position of the vehicle front.

7. The traffic flow measurement method according to claim 1 wherein one of a plurality of candidate points in the measurement area which has more pixels of the edge portion in the mask pattern and which is located downstream along a running direction of the vehicle is finally selected as the vehicle front point to determine the position of the vehicle front.

8. The traffic flow measurement method according to claim 1 wherein:

the vehicle velocity is calculated on the basis of the distance that the front point of the vehicle has moved between a past vehicle front point and a current vehicle front point, the current vehicle front point being detected in a predicted area, the predicted area being defined between a first and second line with respect to a moving direction of the vehicle front point, and wherein the first line, nearest to the past vehicle front point, is a distance from the past vehicle front point equal to a minimum value of a vehicle prediction velocity multiplied by the predetermined time period, and the second line, farthest from the past vehicle front point is a distance from the past vehicle front point equal to a maximum value of the vehicle prediction velocity multiplied by the predetermined time period.

9. The traffic flow measurement method according to claim 8 wherein the minimum value of the vehicle prediction velocity is set at zero or a negative value.

10. A traffic flow measurement apparatus comprising:

an ITV camera for picking up an image of a measurement area set in view of a road;

an image input unit for receiving brightness information of sampling points included in the image information of said ITV camera;

a detection unit for detecting a vehicle front based on the image information from said image input unit, wherein said detection unit, effects spatial differentiation based on brightness information contained in the image information of the sampling points to detect an edge portion of a running vehicle as well as a stopped vehicle, binarizes the brightness information of the sampling points by comparing differentiation signals derived from the spatial differentiation with a predetermined threshold, masks pixels detected as the edge portion of the binary image derived from the binarization with mask patterns respectively having a width corresponding to vehicle types, selects one of the mask patterns having a width in correspondence with a type of the running vehicle, and selects one or more candidate points for the vehicle front as one or more pixels at a center of gravity of the pixels of the edge portion present in the selected mask pattern; and a measurement processing unit, said measurement processing unit determines a vehicle front point at a predetermined time from the candidate points in the measurement area, and calculates a vehicle velocity based on a distance that the vehicle front point has moved in a predetermined time period.

11. The traffic flow measurement apparatus according to claim 10 wherein said detection unit masks across a lane of the road by the respective mask patterns.

12. The traffic flow measurement apparatus according to claim 10 wherein said detection unit prepares said mask patterns, one for each of different vehicle widths.

13. The traffic flow measurement apparatus according to claim 10 wherein said detection unit selects one of a plurality of mask patterns prepared having more pixels of the edge portion than a predetermined reference.

14. The traffic flow measurement apparatus according to claim 10 wherein said measurement processing unit selects one of a plurality of candidate points for the vehicle front present in the measurement area having more pixels of the edge portion in the mask pattern, as an effective point of the vehicle front.

15. The traffic flow measurement apparatus according to claim 14 wherein said measurement processing unit selects one of a plurality of effective points of the vehicle front present in the measurement area which is located downstream along a running direction of the vehicle, as the vehicle front point to determine the position of the vehicle front.

16. The traffic flow measurement apparatus according to claim 10 wherein said measurement processing unit selects one of a plurality of candidate points in the measurement area which has more pixels of the edge portion in the mask pattern and which is located downstream along a running direction of the vehicle, as the vehicle front point to determine the position of the vehicle front.

17. The traffic flow measurement apparatus according to claim 10 wherein, said measurement processing unit calculates the vehicle velocity based on the distance that the front point has moved between a past vehicle front point and a current vehicle front point, the current vehicle front point being detected in a predicted area, the predicted area being defined between a first and a second line with respect to a moving direction of the vehicle front point, and wherein said first line, nearest to the past vehicle front point, is a distance from the past vehicle front point equal to a minimum value of vehicle prediction velocity multiplied by said predetermined time period, and said second line, farthest from the past vehicle front point, is a distance from the past vehicle front point equal to a maximum value of the vehicle prediction velocity multiplied by said predetermined time period.

18. The traffic flow measurement apparatus according to claim 17 wherein the minimum value of the vehicle prediction velocity is set at zero or a negative value.

* * * * *